US006325481B1

(12) United States Patent
Pietz et al.

(10) Patent No.: US 6,325,481 B1
(45) Date of Patent: Dec. 4, 2001

(54) METHOD AND APPARATUS FOR PEN TEMPERATURE CONTROL IN A THERMAL PRINTER

(75) Inventors: Greg P Pietz; Paul D. Bliley, both of Vancouver, WA (US); Arezou Zarafshan; Carl E. Thomsen, both of Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/374,544

(22) Filed: Aug. 13, 1999

(51) Int. Cl.[7] ..... B41J 29/393; B41J 28/38
(52) U.S. Cl. ..... 347/19; 347/14
(58) Field of Search ..... 347/19, 14, 23, 347/49, 10, 15, 11, 12

(56) References Cited

U.S. PATENT DOCUMENTS 4,015,192 * 3/1977 Koyanagi ..... 323/19
4,675,695 * 6/1987 Samuel ..... 346/1.1
5,363,134 * 11/1994 Barbehenn et al. ..... 347/49
6,174,038 * 6/2001 Nakazawa et al. ..... 347/10

* cited by examiner

*Primary Examiner*—John Barlow
*Assistant Examiner*—Charles W. Stewart, Jr.

(57) ABSTRACT

A pen controller in a thermal printer generates a pulse width modulated (PWM) signal based on a reference voltage. The PWM signal is passed through a filter, resulting in a first voltage that varies with the duty cycle of the PWM signal. Additionally, a temperature sensing resistor on a pen of the printer generates a second voltage that varies with the temperature of the pen. A comparator is used to compare the first and second voltages to determine when the pen is at a proper temperature for printing. As the actual reference voltage in a printer may vary from its intended value due to variations in the fabrication process used to create the components of the printer, the printer is calibrated to account for such variations. The printer is calibrated by the pen controller changing the duty cycle of the PWM signal (thereby changing the first voltage) while the second voltage remains relatively constant. The comparator compares the first and second voltages and identifies when the duty cycle results in a first voltage that matches the second voltage. The pen controller can read, via an analog to digital converter channel, the value of the second voltage. Based on both the value of the second voltage (at the point where it which matches the first voltage), and the duty cycle at that point, the pen controller can calculate the actual reference voltage.

19 Claims, 4 Drawing Sheets

METHOD AND APPARATUS FOR PEN TEMPERATURE CONTROL IN A THERMAL PRINTER

TECHNICAL FIELD

This invention relates to thermal printers, and more particularly to pen temperature control in thermal printers.

BACKGROUND

Computer technology is continually advancing, expanding the need for computers in the personal, business, and academic fields. As the need for computers has grown, so too has the need for various peripheral devices for use with computers, such as printers. One type of printer that can be used with computers is referred to as a "thermal" printer. A thermal printer uses a "pen" to apply small droplets of ink to paper to generate a printed version of data (whether it be text pictures, etc.). In a thermal printer, the amount of ink in each droplet is dependent on, among other factors, the temperature of the pen. When the pen is too hot, the droplets are too large, whereas when the pen is too cold, the droplets are too small. Thus, the temperature of the pen in a thermal printer should be regulated carefully in order to achieve an acceptable level of print quality.

The temperature of the pen in a thermal printer can be regulated by supplying energy to the pen in order to heat it, a process referred to as "pulse warming". In order to determine when the pen should be heated, the current temperature of the pen is compared to the temperature the pen should be at for printing (the target temperature). The target temperature is typically hotter than the normal "room" temperature that the printer is located in. If the pen is too cool then pulse warming is used to heat it. If the pen is too hot, then the system waits for the pen to cool down.

In order to accurately compare the current pen temperature to a target temperature, an accurate target temperature must be available to the printer. Various circuitry can be included in a printer to identify a target temperature. However, due to variations in the fabrication process of the circuitry used in the printer, the actual target temperature identified by the circuitry may vary from printer to printer. Such differences in actual versus designed target temperature can affect the print quality of the printer and, if large enough, can actually prevent printing.

One solution to this problem is for each printer to use a channel of a digital to analog converter to generate indication of the target temperature. However, situations can arise where adding a digital to analog converter, or adding an additional channel to a digital to analog converter, is not a desirable option (e.g., there may be design time constraints or hardware cost constraints that make such an addition unattractive). Therefore, it would be beneficial to be able to accurately identify the target temperature without requiring such an additional digital to analog converter or converter channel.

The invention described below addresses these and other disadvantages of the prior art, providing improved pen temperature control in a thermal printer.

SUMMARY

The pen temperature control in a thermal printer is calibrated without requiring the use of an additional digital to analog converter or converter channel. A pen controller in the thermal printer generates a pulse width modulated (PWM) signal based on a reference voltage. The PWM signal is passed through a filter, resulting in a first voltage that varies with the duty cycle of the PWM signal. Additionally, a temperature sensing resistor on the pen generates a second voltage that varies with the temperature of the pen. A comparator is used to compare the first and second voltages to determine when the pen is at a proper temperature for printing.

The actual reference voltage in a printer may vary from its intended value due to variations in the fabrication process used to create the components of the printer. The printer is calibrated to account for such variations by changing the duty cycle of the PWM signal (thereby changing the first voltage) while the second voltage remains relatively constant. The comparator compares the first and second voltages and identifies when the duty cycle results in a first voltage that matches the second voltage. The pen controller can read, via an analog to digital converter channel, the value of the second voltage. Based on both the value of the second voltage at the point where it matches the first voltage, and the duty cycle at that point, the pen controller can calculate the actual reference voltage.

According to one aspect of the invention, an additional refinement or verification process is also used in determining the actual reference voltage. The duty cycle of the PWM signal is set to a new value that results in a first voltage higher than the second voltage. The pen is then warmed, resulting in an increase in the second voltage. At the point where the comparator determines that the first voltage again matches the second voltage, the second voltage and the new value of the duty cycle are used to calculate the actual reference voltage. This reference voltage may be used to verify the previously calculated reference voltage, or alternatively can be used in combination with the previously calculated reference voltage to determine the actual reference voltage.

BRIEF DESCRIPTION OF THE DRAWINGS

The present invention is illustrated by way of example and not limitation in the figures of the accompanying drawings. The same numbers are used throughout the figures to reference like components and/or features.

DETAILED DESCRIPTION

In the discussions to follow, reference is made to signals being at a "high value" or at a "low value". A high value typically refers to a signal having a voltage between 1.5 and 5.5 volts. A low value typically refers to a signal having a voltage between 0.0 and 0.5 volts.

Figure 1:
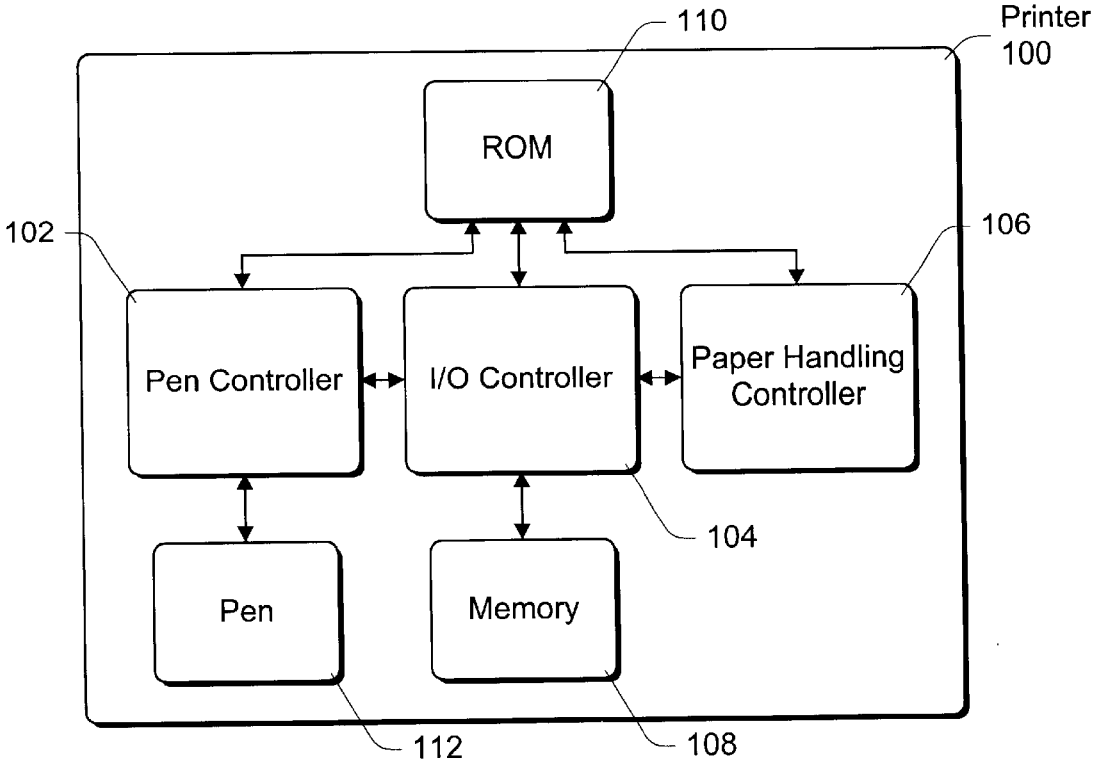
FIG. 1 is a block diagram illustrating a thermal printer in accordance with an embodiment of the invention.

FIG. 1 is a block diagram illustrating a thermal printer in accordance with an embodiment of the invention. Thermal printer 100 can be coupled to, or alternatively incorporated as part of, any of a wide variety of conventional computing devices. Examples of such devices include desktop or notebook computers, hand-held computers, hand-held "point of sale" or similar computing devices, etc.

As illustrated, a printer 100 includes a pen controller 102, an input/output (I/O) controller 104, a paper handling controller 106, memory 108, read only memory (ROM) 110, and a pen 112. Pen controller 102, I/O controller 104, and paper handling controller 106 operate, at least in part, by executing instructions (typically referred to as "firmware") residing in ROM 110. I/O controller 104 interfaces with devices external to printer 100, such as a computer (not shown) from which the data to be printed is received. Data to be printed is received by I/O controller 104 and temporarily stored in memory 108. Memory 108 can be any of a wide variety of conventional storage devices, such as volatile random access memory (RAM).

I/O controller 104 communicates with paper handling controller 106, which controls the paper-feeding mechanism (not shown) of the printer to pass a sheet of paper (or other printable medium) through the printer. I/O controller 104 also communicates the data from memory 108 to pen controller 102. Pen controller 102, based on the received data, controls pen 112 to dispense ink droplets as appropriate onto the paper being fed through the printer. Pen 112 is intended to represent any of a variety of thermally-controlled ink dispensing devices that can be used with thermal printers. Although only a single pen is illustrated in FIG. 1, it is to be appreciated that printer 100 can include multiple pens. For example, if printer 100 is a color printer then a pen with black ink and one or more pens with different colored ink may be included in printer 100.

Pen 112 is illustrated in FIG. 1 as being part of printer 100. It should be noted that pen 112 may be a removable cartridge, allowing for replacement by a user (for example, when the pen runs out of ink). Insertion of a removable pen 112 into printer 100 creates an electrical coupling between pen 112 and pen controller 102, allowing data and control information to be communicated between pen 112 and controller 102. Alternatively, pen 112 may be a fixed, non-removable pen.

Figure 2:
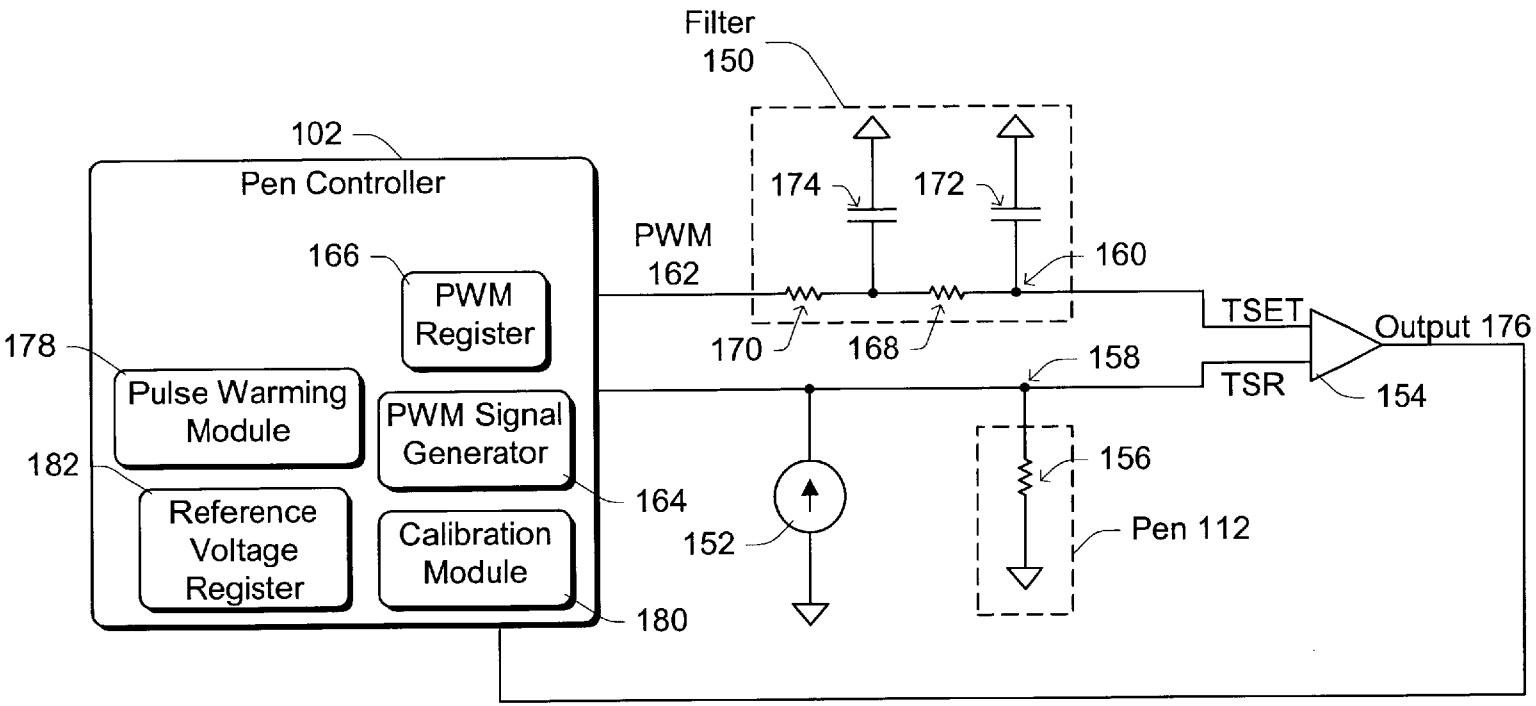
FIG. 2 illustrates exemplary circuitry allowing for calibration of pen temperature control in accordance with the invention.

FIG. 2 illustrates exemplary circuitry allowing for calibration of pen temperature control in accordance with the invention. In the illustrated example, pen controller 102 is a processor or microcontroller (such as an application specific integrated circuit (ASIC)). Pen controller 102 is coupled to a filter 150, a current source 152, and a comparator 154, all of which are incorporated as part of a printer (e.g., printer 100 of FIG. 1). In the illustrated example, pen controller 102 and comparator 154 are incorporated in an integrated circuit (IC) that is electrically coupled to a same printed circuit board (PCB) that filter 150 is also coupled to. Pen controller 102 is also coupled to a temperature sensing resistor (TSR) 156, which is part of a pen (e.g., pen 112 of FIG. 1). It is to be appreciated that additional circuitry is also included in pen controller 102 and pen 112 to make printing possible, however, this additional circuitry is not particularly germane to the invention and thus has not been illustrated.

Comparator 154 compares a voltage based on a signal generated by pen controller 102 to a voltage representative of the temperature of the pen 112. Controller 102 uses the results of this comparison to calibrate the pen temperature control by ascertaining the proper voltage to supply to comparator 154, as well as how to generate that proper voltage.

TSR 156 provides a variable resistance dependent on its temperature—the resistance increases as the temperature increases. By placing TSR 156 on the pen, TSR 156 can be used to provide an indication of the temperature of the pen. TSR 156 and a current source 152 are coupled to a node 158. Current source 152 provides a constant current source while TSR 156 varies depending on pen temperature. Thus, using the well-known ohm's law (V=IR), it can be seen that the voltage at node 158 is dependent on the temperature of the pen, increasing as the temperature increases and decreasing as the temperature decreases. The voltage at node 158 is referred to as the TSR voltage.

An analog to digital (A/D) channel of pen controller 102 is coupled to node 158. This coupling allows pen controller 102 to read the voltage at node 158.

Pen controller 102 is also coupled to provide a pulse width modulated (PWM) signal 162 to filter 150. Controller 102 includes a PWM signal generator 164 and a PWM register 166. PWM signal generator 164 generates a PWM signal 162 having a duty cycle based on a value stored in register 166. Generator 164 can be implemented in hardware, or alternatively can be implemented in firmware executed by controller 102.

The PWM signal 162 is an oscillating signal designed to have a low or minimum value of 0.0 volts and a high or maximum value of 5.0 volts. This high value is referred to herein as the "reference" voltage. The duty cycle of signal 162 refers to how long, during its oscillation, the signal 162 is at the high value. By way of example, a signal having a duty cycle of 60% would be at its high value 60% of the time.

Register 166 is a multiple-bit register which identifies the duty cycle for signal 162. In the illustrated example, register 166 is a 9-bit register. Alternatively, register 166 could have a fewer or greater number of bits. The number of bits in register 166 determines how much granularity generator 164 has in the generation of signal 162. When register 166 is a 9-bit register, $2^9$ (512) different duty cycles can be generated. Thus, in the exemplary illustration, given that the duty cycle can range from 0% to 100%, each of the 100 different duty cycles differs by $100 \div (2^9 - 1) = 0.196\%$. Based on the programming of register 166, generator 164 operates in a conventional manner to generate a PWM signal 162 having the appropriate duty cycle.

Filter 150 provides a voltage at node 160 that is referred to as the TSET (target setting) voltage. The TSET voltage, as discussed in more detail below, is the voltage the node 158 should be at in order for the pen to be at the proper temperature for printing (the target temperature). Filter 150 in the exemplary illustration is a low pass filter including resistors 168 and 170 as well as capacitors 172 and 174, coupled together as illustrated. In the illustrated example, resistors 168 and 170 are both 20 k ohm resistors, while capacitors 172 and 174 are both 0.1 microfarad capacitors. Filter 150 causes a voltage at node 160 to be at the value determined by multiplying the duty cycle of signal 162 by the reference voltage of PWM signal 162. Thus, by way of example, if the reference voltage of signal 162 is 5.0 volts and the duty cycle is 50%, then the voltage at node 160 is 2.5 volts, whereas if the reference voltage of signal 162 is 4.6 volts and the duty cycle is 50%, then the voltage at node 160 is 2.3 volts.

During operation of the printer, the TSET voltage at node 160 is used to determine whether the pen needs to be warmed before printing. Comparator 154 compares the temperature of the pen, represented by the TSR voltage at node 158, to the TSET voltage at node 160. If the voltage at node 160 is equal to or greater than the voltage at node 158, then comparator 154 outputs a comparison signal 176 in a first state (e.g., a high value), whereas if the voltage at node 160 is less than the voltage at node 158, then comparator 154 outputs signal 176 in a second state (e.g., a low value). The output signal 176 is provided to pen controller 102 for use during a pen temperature calibration process as discussed in more detail below.

During operation of the printer, output signal 176 is provided to a pulse warming module 178 of controller 102 to indicate when the pen needs to be warmed for printing. The output signal 176 being in the second state indicates that the pen is at a high enough temperature for printing. The output signal 176 being in the first state indicates that the pen is not at a high enough temperature for printing, so the pulse warming module warms the pen until the temperature, as indicated by output signal 176, is high enough. Pulse warming of the pen is well known to those skilled in the art and thus will not be discussed further except as it pertains to the invention.

It should be noted that, in order for the TSET voltage to be accurate, the reference voltage of the PWM signal 162 needs to be known. By way of example, if the TSR voltage should be at 2.5 volts in order for the pen to be at the proper temperature, then the TSET voltage should also be 2.5 volts. Pen controller 102 may be designed to provide a PWM signal 162 with a reference voltage of 5.0 volts, so generator 164 would be programmed to generate a PWM signal 162 having a 50% duty cycle causing the TSET voltage to be 2.5 volts. However, due to variations in the fabrication process of the components of printer 100, the reference voltage may actually be only 4.6 volts, which, with a 50% duty cycle, would result in a TSET voltage of 2.3 volts. Thus, even though the pen should be at a temperature to create a TSR voltage of 2.5 volts, comparator 154 will provide output signal 176 indicating that the pen is warm enough when the TSR voltage is only at 2.3 volts.

This situation is resolved in controller 102 by use of a calibration module 180. Calibration module 180 determines, via a process referred to as "calibration" of the PWM signal, what the reference voltage of PWM signal 162 actually is. Thus, calibration module 180 can determine, accounting for variations in the fabrication process, what the duty cycle of PWM signal 162 should be in order to generate a proper TSET voltage. The calibration process of module 180 is performed when the printer is powered-on. Alternatively, the calibration process may be performed at additional times, such as during a printer "reset", when a pen is replaced, etc. Calibration module 180 can be implemented in hardware, or alternatively can be implemented in software or firmware executed by controller 102, or any combination of hardware, software, and firmware.

Pen controller 102 may also include a reference voltage register 182. Reference voltage register 182 provides storage for the reference voltage that is determined by calibration module 180. Reference voltage register 182 may also store one or more estimated reference voltages for use during the calibration module. The determination of the reference voltage and/or estimated reference voltages is discussed in more detail below with reference to FIGS. 3 and 4.

Figure 3:
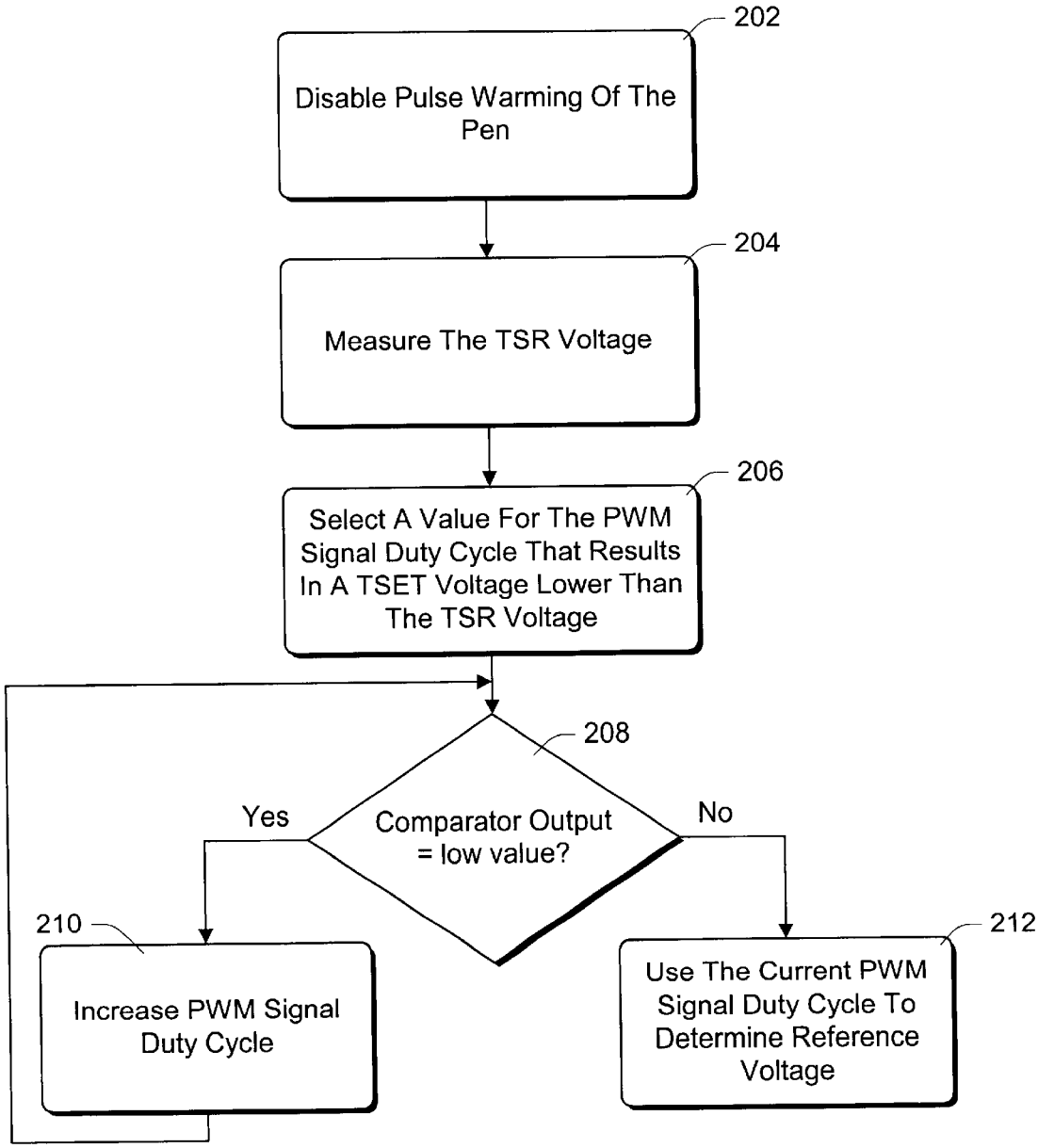
FIG. 3 is a flowchart illustrating an exemplary process for calibrating the pulse width modulated signal in accordance with the invention.

FIG. 3 is a flowchart illustrating an exemplary process for calibrating the PWM signal in accordance with the invention. The process of FIG. 3 is implemented by calibration module 180 of FIG. 2 and may be performed in software or firmware. The process is described with additional reference to FIG. 2.

Initially, calibration module 180 disables pulse warning of the pen (step 202) by sending a disable signal to pulse warning module 178. Pulse warming is disabled to prevent any heating of the pen from interfering with the calibration process. Module 180 then measures the TSR voltage (step 204) and selects a value for the duty cycle of the PWM signal 162 that results in a TSET voltage lower than the TSR voltage (step 206). For purposes of step 206, module 180 assumes that the actual reference voltage for PWM signal 162 is very high (e.g., 5.5 volts). Module 180 may initially set the duty cycle at 0%, or alternatively calculate a value that results in a voltage that is closer to the TSR voltage (e.g., initially set the register 166 to the value 256).

Module 180 then checks whether the output of comparator 154 is in a second state (e.g., at a low value, step 208). If the output is in the second state (e.g., the output signal 176 is at the low value), then module 180 increases the PWM signal duty cycle (step 210). This increase is accomplished by increasing the value in PWM register 166. Module 180 then repeats the evaluation and checking steps 208 and 210, respectively.

Eventually, the PWM signal duty cycle will increase to a value that causes the comparator to output a value at the first state (e.g., the output signal 176 is at a high value), indicating that the TSET voltage is equal to or greater than the TSR voltage. When this occurs, the current PWM signal duty cycle is used to determine the reference voltage of the PWM signal (step 212). Given the duty cycle granularity provided by register 166, module 180 assumes that the TSET voltage is equivalent to the TSR voltage at the time the comparator output changes from the second state to the first state. Thus, module 180 can calculate the reference voltage of the PWM signal using the following equation:

$$\text{reference voltage} = \text{TSR voltage} \div \text{duty cycle}$$

where reference voltage equals the reference voltage of the PWM signal, TSR voltage equals the TSR voltage measured in step 204, and duty cycle equals the duty cycle that caused the comparator output to change from the second state to the first state.

Alternatively, rather than selecting an initial duty cycle that is too low, module 180 may initially set a duty cycle that is too high (causing the output of comparator 154 to be in the first state). Module 180 can then reduce the duty cycle until the comparator output changes from the first state to the second state, at which point the reference voltage of the PWM signal can be determined based on the TSR voltage divided by the duty cycle, as discussed above.

In the illustrated example, the PWM duty cycle is increased in step 210 based on an expected duty cycle. Calibration module 180, knowing the TSR voltage and knowing what the reference voltage was designed to be, can readily determine an expected duty cycle. For example, if the TSR voltage is 2.5 volts, and the reference voltage was designed to be 5.0 volts, then module 180 can readily determine that the duty cycle is expected to be 50%. In increasing the PWM signal duty cycle in step 210, module 180 increases the duty cycle by an amount equal to half the difference between the current duty cycle and the expected duty cycle.

By way of example, assume that the expected duty cycle is 50%, that the selected value in step 206 is 0%, and that the initial comparator output is at the second state. The PWM signal duty cycle is then increased in step 210 by an amount equal to half the difference between the current duty cycle (0%) and the expected duty cycle (50%), or 25%. If the output of the comparator continues to be at the second state, then the PWM signal duty cycle is next increased in step 210 by an amount equal to half the difference between the current duty cycle (25%) and the expected duty cycle (50%), or 12.5%.

Alternatively, other methods for increasing the PWM signal duty cycle may be used. For example, the PWM signal duty cycle may be continually incremented by a set amount, such as the smallest amount allowed given the size of PWM register 166 (e.g., 0.196%).

Figure 4:
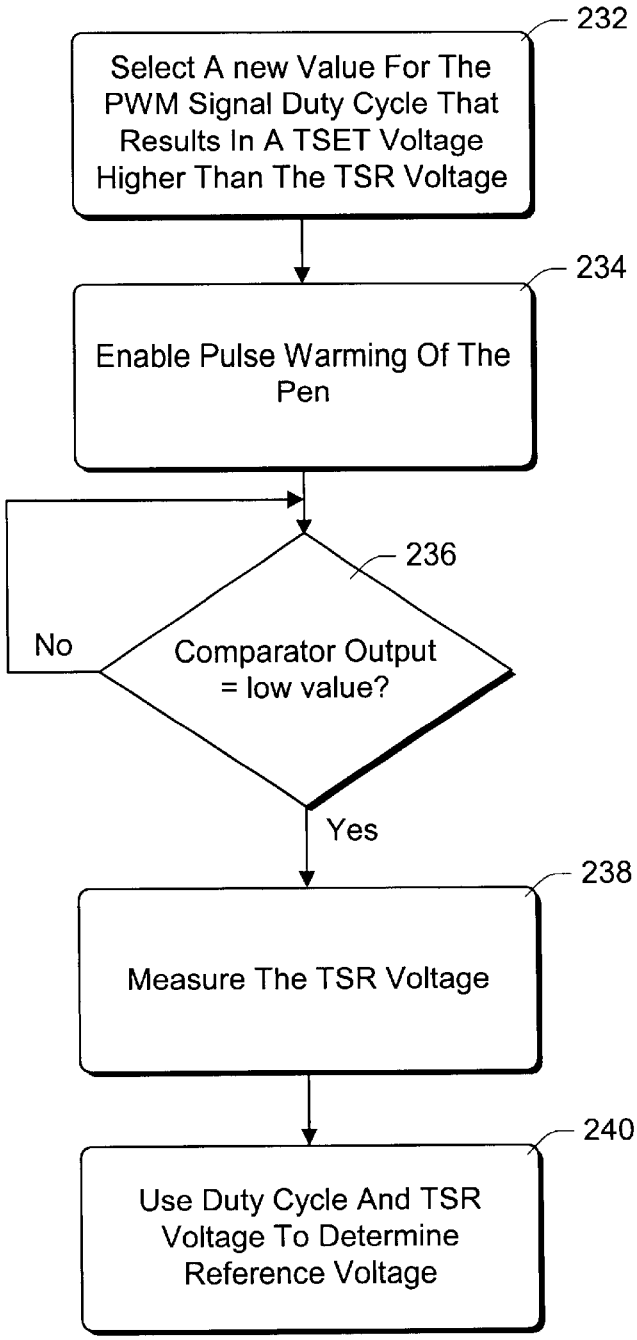
FIG. 4 is a flowchart illustrating an exemplary process for refining the calibrating of the pulse width modulated signal in accordance with the invention

FIG. 4 is a flowchart illustrating an exemplary process for refining the calibrating of the PWM signal in accordance with the invention. The process of FIG. 4 is implemented by calibration module 180 of FIG. 2 and may be performed in software or firmware. The process is described with additional reference to FIGS. 2 and 3.

After determining the PWM signal reference voltage in step 214 of FIG. 3, module 180 selects a new value for the PWM signal duty cycle that results in a TSET voltage higher than the TSR voltage (step 232). In the illustrated example, the PWM signal duty cycle is selected to generate a TSET voltage that corresponds to the highest voltage that node 158 of FIG. 2 is expected to be at during operation of the printer (that is, corresponding to the highest temperature the pen is expected to be at).

Module 180 then enables pulse warming of the pen (step 234) by sending an enable signal to pulse warming module 178. With pulse warming enabled, given that the TSET voltage is higher than the TSR voltage, the pen will be pulse warmed. With the pen warming, module 180 checks whether the comparator output is at the second state, (e.g., at a low value, step 236). Module 180 continues to check the output until the comparator output is at the second state, at which point module 180 measures the TSR voltage (step 238). Module 180 then uses the duty cycle from step 232 and the TSR voltage from step 238 to determine the reference voltage of the PWM signal (step 240), analogous to step 212 of FIG. 3.

The refinement process of FIG. 4 results in an additional "reading" of the reference voltage of the PWM signal. The TSR voltage (or the TSET voltage) in conjunction with the duty cycle can be used to determine the reference voltage of the PWM signal. As minor discrepancies may occur as the temperature changes, the different readings provide a more accurate measurement of the reference voltage. Module 180 treats the two different reference voltages (from step 212 of FIG. 3 and 240 of FIG. 4) as "estimated" reference voltages at this point. These estimated reference voltages can then be used to generate the actual reference voltage of the PWM signal (for example, by taking the average of the two voltages). Alternatively, module 180 may maintain both values, allowing controller 102 to use either of the two values depending on the current desired temperature of the pen.

Alternatively, the process of FIG. 4 can be used to verify the process of FIG. 3. If the two processes result in two values for the reference voltage of the PWM signal that are greater than a threshold amount, then other "recovery" steps may be taken. For example, the process of FIG. 3 may be repeated, an error indication may be given, etc.

Thus, a method and apparatus for pen temperature control in a thermal printer has been described. The invention identifies, accounting for any fabrication variances, a reference voltage used to determine whether the pen is at the proper temperature for printing. The invention advantageously identifies the reference voltage without the need for additional analog to digital converters or converter channels within the printer.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of calibrating a thermal printer, the method comprising:

measuring a first voltage at a node coupled to a temperature sensing resistor that indicates a temperature of a pen of the thermal printer;

generating a pulse width modulated signal, based on a reference voltage, having a duty cycle corresponding to a second voltage that is less than the first voltage;

changing the duty cycle to identify a new duty cycle at which the second voltage is equal to or greater than the first voltage; and using the new duty cycle to determine the reference voltage.

2. A method as recited in claim 1, wherein the changing comprises incrementing the duty cycle in steps, each step comprising an amount equal to half the difference between the current duty cycle and an expected duty cycle, the expected duty cycle being an estimate of the new duty cycle.

3. A method as recited in claim 1, wherein the using comprises dividing, to ascertain the reference voltage, the first voltage by a value representative of the duty cycle.

4. A method as recited in claim 1, further comprising disabling pulse warming of the pen prior to performing the measuring.

5. A method as recited in claim 1, wherein the generating further comprises initially using a voltage of zero as the second voltage.

6. A method of calibrating a thermal printer, the method comprising:

measuring a first voltage at a node coupled to a temperature sensing resistor that indicates a temperature of a pen of the thermal printer;

generating a pulse width modulated signal, based on a reference voltage, having a duty cycle corresponding to a second voltage that is less than the first voltage;

changing the duty cycle to identify a new duty cycle at which the second voltage is equal to or greater than the first voltage;

using the new duty cycle to determine the reference voltage;

selecting a second duty cycle that is greater than the new duty cycle, resulting in a third voltage that is greater than the first voltage;

allowing the pen to be pulse warmed until the third voltage is equal to or greater than the first voltage; and using the first voltage and the second duty cycle to determine a first estimated reference voltage.

7. A method as recited in claim 6, wherein the using the new duty cycle comprises generating a second estimated reference voltage based on the new duty cycle.

8. A method as recited in claim 7, further comprising averaging the first estimated reference voltage and the second estimated reference voltage to determine the reference voltage.

9. A method as recited in claim 7, further comprising storing the first estimated reference voltage and the second estimated reference voltage.

10. One or more computer-readable media having stored thereon a computer program that, when executed by a processor, causes the processor to perform functions to calibrate a thermal printer including:

measuring a first voltage at a node coupled to a temperature sensing resistor that indicates a temperature of a pen of the thermal printer;

generating a pulse width modulated signal, based on a reference voltage, having a duty cycle corresponding to a second voltage that is less than the first voltage;

changing the duty cycle to identify a new duty cycle at which the second voltage is equal to or greater than the first voltage; and using the new duty cycle to determine the reference voltage.

11. One or more computer-readable media as recited in claim 10, wherein the using comprises dividing, to ascertain the reference voltage, the first voltage by a value representative of the duty cycle.

12. One or more computer-readable media having stored thereon a computer program that, when executed by a processor, causes the processor to perform functions to calibrate a thermal printer including:

measuring a first voltage at a node coupled to a temperature sensing resistor that indicates a temperature of a pen of the thermal printer;

generating a pulse width modulated signal, based on a reference voltage, having a duty cycle corresponding to a second voltage that is less than the first voltage;

changing the duty cycle to identify a new duty cycle at which the second voltage is equal to or greater than the first voltage;

using the new duty cycle to determine the reference voltage;

selecting a second duty cycle that is greater than the new duty cycle, resulting in a third voltage that is greater than the first voltage;

allowing the pen to be pulse warmed until the third voltage is equal to or greater than the first voltage; and using the first voltage and the second duty cycle to determine a first estimated reference voltage.

13. One or more computer-readable media as recited in claim 12, wherein the using the new duty cycle comprises generating a second estimated reference voltage based on the new duty cycle.

14. One or more computer-readable media as recited in claim 13, wherein the program, when executed by the processor, further causes the processor to perform a function of averaging the first estimated reference voltage and the second estimated reference voltage to determine the reference voltage.

15. An apparatus comprising:

a controller to generate a pulse width modulated signal;

a filter coupled to the pulse width modulated signal providing a first voltage based on the pulse width modulated signal;

a node, coupled to the controller, being at a second voltage;

a comparator coupled to receive the first voltage and the second voltage, the comparator outputting a signal having a first state if the first voltage is less than the second voltage, and outputting the signal having a second state if the first voltage is greater than or equal to the second voltage; and wherein the controller is to identify a reference voltage of the pulse width modulated signal based on the signal output by the comparator as the first voltage is varied.

16. An apparatus as recited in claim 15, wherein the filter comprises a low pass filter.

17. An apparatus as recited in claim 15, wherein the node is coupled to a temperature sensing resistor indicating a temperature of a pen of a thermal printer.

18. An apparatus as recited in claim 15, wherein the apparatus comprises a printer.

19. An apparatus comprising:

a controller to generate a pulse width modulated signal;

a filter coupled to the pulse width modulated signal providing a first voltage based on the pulse width modulated signal;

a node, coupled to the controller, being at a second voltage;

a comparator coupled to receive the first voltage and the second voltage, the comparator outputting a signal having a first state if the first voltage is less than the second voltage, and outputting the signal having a second state if the first voltage is greater than or equal to the second voltage;

wherein the controller is to identify a reference voltage of the pulse width modulated signal based on the signal output by the comparator as the first voltage is varied; and wherein the controller is further to measure the second voltage, generate the pulse width modulated signal having a duty cycle that, when the pulse width modulated signal is supplied to the filter, causes the filter to provide the first voltage being less than the second voltage, and increase the duty cycle until the first voltage is greater than or equal to the second voltage.

* * * * *